US009915144B2

(12) United States Patent
Manzar et al.

(10) Patent No.: US 9,915,144 B2
(45) Date of Patent: Mar. 13, 2018

(54) PRODUCTION LOGGING TOOL WITH MULTI-SENSOR ARRAY

(71) Applicant: Baker Hughes Incorporated, Houston, TX (US)

(72) Inventors: Muhammad A. Manzar, Spring, TX (US); Hayward Atkinson, Spring, TX (US); Jeffrey C. Neely, Houston, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 388 days.

(21) Appl. No.: 14/539,299

(22) Filed: Nov. 12, 2014

(65) Prior Publication Data

US 2016/0130935 A1 May 12, 2016

(51) Int. Cl.

| | |
|---|---|
| ***E21B 47/09*** | (2012.01) |
| ***E21B 47/10*** | (2012.01) |
| ***E21B 47/01*** | (2012.01) |
| ***E21B 17/10*** | (2006.01) |

(52) U.S. Cl.

CPC ..... *E21B 47/102* (2013.01); *E21B 17/1021* (2013.01); *E21B 47/01* (2013.01)

(58) Field of Classification Search

CPC ..... E21B 47/09; E21B 47/10; E21B 47/102; E21B 17/1014–17/1028; G01N 33/28–33/30

USPC ..... 73/152.29, 152.34, 152.31, 73/152.01–152.62, 861.01–861.41; 175/50; 166/250.01

See application file for complete search history.

(56) References Cited

U.S. PATENT DOCUMENTS

| | | | | |
|---|---|---|---|---|
| 4,715,440 | A * | 12/1987 | Boxell | E21B 17/1021 166/100 |
| 4,928,758 | A | 5/1990 | Siegfried, II | |
| 4,974,446 | A | 12/1990 | Vigneaux | |
| 5,531,112 | A | 7/1996 | Young et al. | |
| 5,917,774 | A * | 6/1999 | Walkow | E21B 47/08 166/100 |
| 6,176,129 | B1 * | 1/2001 | Aguesse | E21B 47/10 73/152.29 |
| 7,114,386 | B1 * | 10/2006 | Veignat | E21B 47/10 73/152.29 |
| 2006/0064889 | A1 | 3/2006 | Fredette | |
| 2008/0134774 | A1 | 6/2008 | Oddie | |
| 2008/0258739 | A1 | 10/2008 | Niwa | |

FOREIGN PATENT DOCUMENTS

| | | | |
|---|---|---|---|
| CN | 203216998 U | * | 9/2013 |
| WO | WO 2013067540 A1 | | 5/2013 |

* cited by examiner

*Primary Examiner* — George S Gray

(74) *Attorney, Agent, or Firm* — Bracewell LLP; Keith R. Derrington

(57) ABSTRACT

A logging tool for use downhole includes sensor modules that monitor fluid flow in a wellbore. The sensor modules are disposed on flexible arms that project radially outward from the logging tool, so that the modules are located at discrete radial positions in the wellbore. The sensor modules include a flow sensor, an optical sensor, and a fluid conductivity sensor. The rate and type of fluid flowing in the wellbore can be estimated due to employing the different sensor types. A location sensor estimates the radial location of the modules so that a flow profile of the flowing fluid can be obtained.

13 Claims, 6 Drawing Sheets

24
10
32
30
12A

PRODUCTION LOGGING TOOL WITH MULTI-SENSOR ARRAY

BACKGROUND OF THE INVENTION

1. Field of Invention

The present disclosure relates in general to monitoring flow in a wellbore, and more specifically to sensing fluid flow at discrete and known locations in the wellbore.

2. Description of Prior Art

Flowmeters are often used for measuring flow of fluid produced from hydrocarbon producing wellbores. Flowmeters may be deployed downhole within a producing wellbore, a jumper or caisson used in conjunction with a subsea wellbore, or a production transmission line used in distributing the produced fluids. Monitoring fluid produced from a wellbore is useful in wellbore evaluation and to project production life of a well. In some instances transmission lines may include fluid produced from wells having different owners. Therefore proper accounting requires a flow measuring device that monitors the flow contribution from each owner.

The produced fluid may include water and/or gas mixed with liquid hydrocarbon. Knowing the water fraction is desirable to ensure adequate means are available for separating the water from the produced fluid. Additionally, the amount and presence of gas is another indicator of wellbore performance, and vapor mass flow impacts transmission requirements. Flowmeters can be employed that provide information regarding total flow, water cut amount, and gas fractions. However, these often require periodic analysis of the fluid entering the flowmeter. This may involve deploying a sample probe upstream of the flowmeter; which can produce inaccuracy, and may interrupt or temporarily halt fluid production.

SUMMARY OF THE INVENTION

Described herein is an example of a downhole tool for use in a wellbore which includes a body and a sensor module coupled with the body and in selective contact with fluid in the wellbore, and that has a fluid flow meter and a fluid phase sensor. The fluid phase sensor can include a conductivity sensor and an optical sensor. In an example, the fluid flow meter and fluid phase sensor are disposed at substantially the same radial distance from the body. In an alternative, the sensor module is disposed on an elongate arm having an end that couples with the body and a mid-section that selectively contacts a wall of the wellbore. In this example, the sensor module is a first sensor module, and the elongate arm is a first elongate arm, the first sensor module and the first elongate arm define a first sensor assembly, and wherein a second sensor assembly having a second sensor module and second elongate arm couples to the body at a location spaced angularly away from the first sensor assembly, and wherein the second elongate arm moves independently of the first elongate arm. Further included in this example is a position sensor in communication with the arm, so that when the arm and sensor module project radially outward from the body, a radial distance of the sensor module from the body can be estimated. In one example, the position sensor includes a slider block pivotingly coupled to an end of the arm and that slides axially along a length of the body in response to the arm flexing radially away from and towards the body, a rod coupled to an end of the slider block and that moves axially with the slider block, and a receiver that circumscribes a portion of the rod and that selectively monitors the position of the rod. In one alternative, the sensor module includes a first sensor module, wherein a second sensor module is disposed on the arm at a distance from an axis of the body that is different from a distance between the first sensor module and the axis of the body, and wherein the first and second sensor modules are at a known distance from the axis of the body. Further alternatively included is a linkage bar having an end pivotingly coupled with the body and a distal end pivotingly coupled with the sensor module, so that when the arm moves radially with respect to the body, the sensor module is retained in an orientation substantially parallel with an axis of the body.

Also described herein is another example of a downhole tool for use in a wellbore that includes a body, an elongate arm having an end coupled with the body and having a mid-portion selectively projecting radially outward from the body to different distances from the body, a sensor module mounted on the arm and that comprises a fluid flow meter and fluid phase monitor, and a means for estimating a distance between the sensor module and an axis of the body when the sensor module moves in response to the mid-portion of the arm projecting to the different distances. Optionally, the fluid phase monitor is made up of an optical sensor and conductivity sensor. In an alternative, the end of the arm is a first end, the arm further having a second end that is slidingly coupled to the body, and wherein the means for estimating a distance is a linear variable differential transformer that receives a magnetic rod that is coupled to the second end of the arm. Further alternatively included is a linkage arm having an end pivotingly coupled to the body, and a distal end pivotingly coupled to the sensor module, so that when the mid-portion moves with respect to the body, the sensor module remains substantially parallel with the axis of the body. In an example, the fluid flow meter is a spinner member that rotates on a shaft, and wherein monitoring rotation of the shaft provides an indication of a rate of flow of fluid in the wellbore.

Further disclosed herein is an example method of estimating a flow of fluid within a wellbore which includes providing a downhole tool having a sensor module that is made up of a fluid flow meter and fluid phase monitor, disposing the downhole tool in the wellbore to define an annulus between the downhole tool and a wall of the wellbore, deploying the sensor module radially outward from the downhole tool and into a flow of fluid in the wellbore, and measuring a rate of flow of fluid and identifying a phase of the fluid at a known location in the annulus. The method may further include providing a multiplicity of sensor modules at a multiplicity of known locations in the annulus. Identifying the phase of the fluid can involve using an optical sensor and a conductivity sensor that is disposed in the flow of fluid. The method can further include providing a multiplicity of arms on a body of the downhole tool and on which the sensor modules are disposed, wherein the arms have a mid-portion that moves radially with respect to the body. In this example, each mid-portion moves independently of mid-portions on other arms. Further optionally included in the example method is a step of providing a multiplicity of arms on a body of the downhole tool and on which the sensor modules are disposed, and wherein movement of the arms is monitored to estimate the known location of the sensor modules.

BRIEF DESCRIPTION OF DRAWINGS

Some of the features and benefits of the present invention having been stated, others will become apparent as the description proceeds when taken in conjunction with the accompanying drawings, in which.

Figure 5:
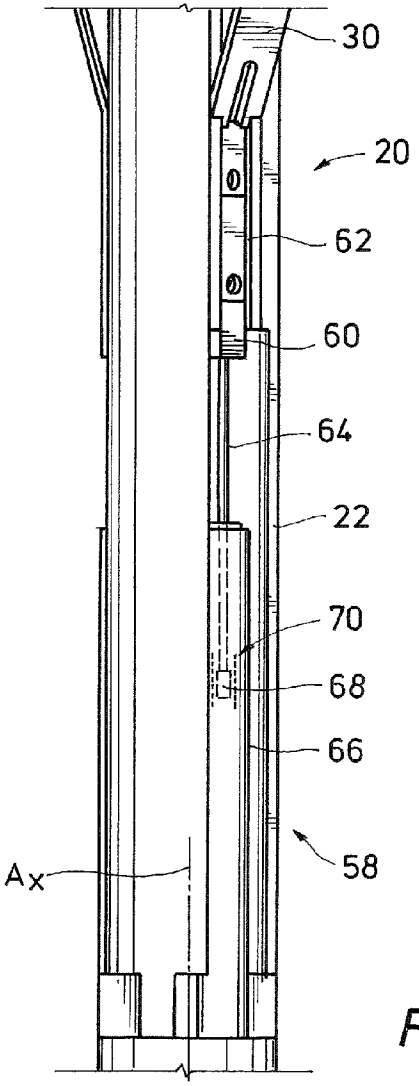
FIG. 5 is a side view of an example of a position sensor mounted in the logging tool of FIG. 1.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
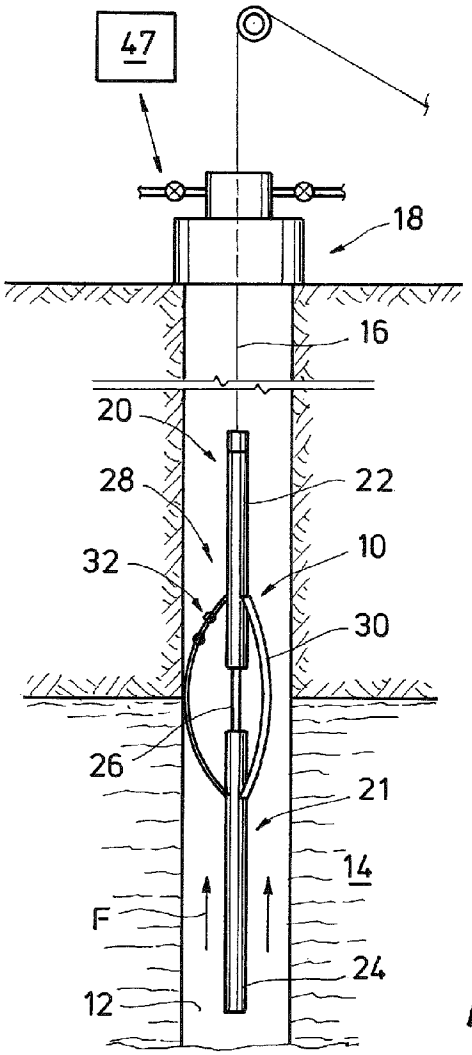
FIG. 1 is a side partial sectional view of an example of a downhole logging tool disposed in a wellbore.

FIG. 1 shows in partial cross-sectional view one example of a downhole logging tool 10 disposed in a wellbore 12. In this example, wellbore 12 intersects a subterranean formation 14, and from which hydrocarbons may be produced. Logging tool 10 is disposed on a wireline 16 shown threaded through a wellhead assembly 18 disposed on the surface and above the opening of wellbore 12. Logging tool 10 includes a body 20 that defines an annulus 21 when body 20 is disposed within wellbore 12. Body 20 is bisected into an upper portion 22 and lower portion 24 that are coupled together via an elongated and axial connector rod 26. In the illustrated example, lower portions 22, 24 are generally cylindrical elongate members and each have an outer diameter that is greater than an outer diameter of connector rod 26. Shown circumscribing connector rod 26 and extending between upper and lower portions 22, 24 are a series of sensor assemblies 28. As shown, each sensor assembly 28 is made up of a sensor arm 30, and one or more sensor modules 32 disposed on the sensor arm 30. In examples where a flow of fluid F makes its way in wellbore 12 and through annulus 21, sensor assemblies 28 project into annulus 21, and thus disposed in the flow of fluid F. As will be described in more detail below, the sensor assemblies 28 can monitor, record, and selectively transmit information about the flow of fluid F to a location remote from the annulus 21.

Figure 2:
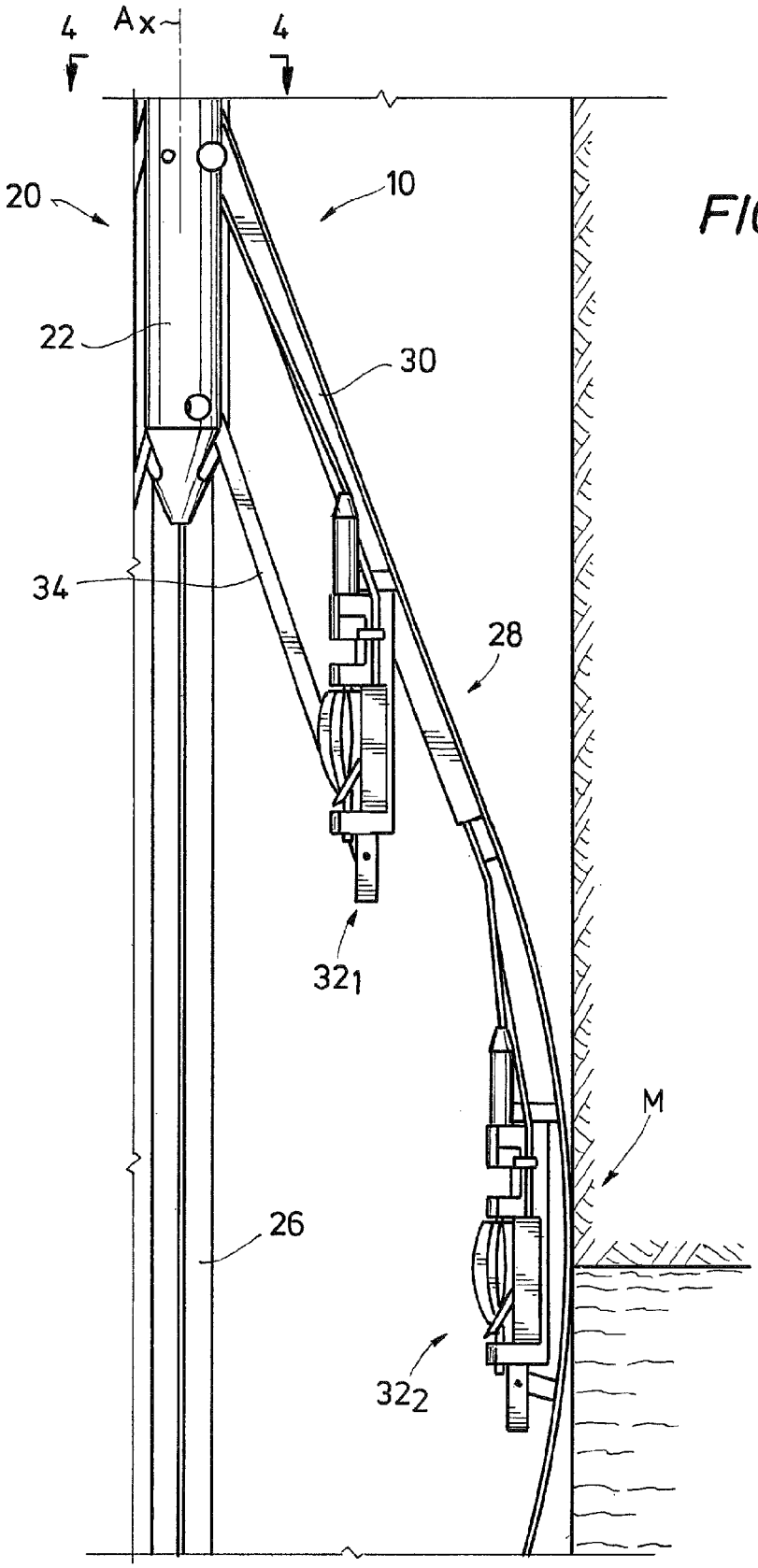
FIG. 2 is a side view of an embodiment of a sensor assembly which is disposed on a portion of the logging tool of FIG. 1.

FIG. 2 shows in a side view a detailed example of a sensor assembly 28 of FIG. 1. In this embodiment, sensor assembly 28 includes a pair of sensor modules $\mathbf{32}_1$, $\mathbf{32}_2$, each mounted on an elongate and flexible sensor arm 30. In this example, one end of sensor arm 30 pivotingly couples to an upper portion 22 of body 20. Thus, when tool 10 is disposed in a wellbore having diameters that vary in size, the arm 30 may flex radially inward or outwardly depending on the specific dimensions of the wellbore, and outer diameter of the mid-section M of the sensor arms 30. An optional linkage arm 34 is shown having one end pivotingly connected to a portion of upper portion 22, and an opposite end pivotingly connected to a body portion of sensor module $\mathbf{32}_1$. Strategically positioning the elongate linkage arm 34, in combination with its pivoting connection to the upper portion 22 and sensor module $\mathbf{32}_1$, provides a support for sensor module $\mathbf{32}_1$ that, as will be described in more detail below, maintains its orientation to be generally parallel to an axis $A_X$ of body 20. Further in the example, sensor module $\mathbf{32}_2$ is disposed on arm 30 and spaced radially outward from module $\mathbf{32}_1$. In this example, sensor module $\mathbf{32}_2$ is disposed radially outward from sensor module $\mathbf{32}_1$.

Figure 3:
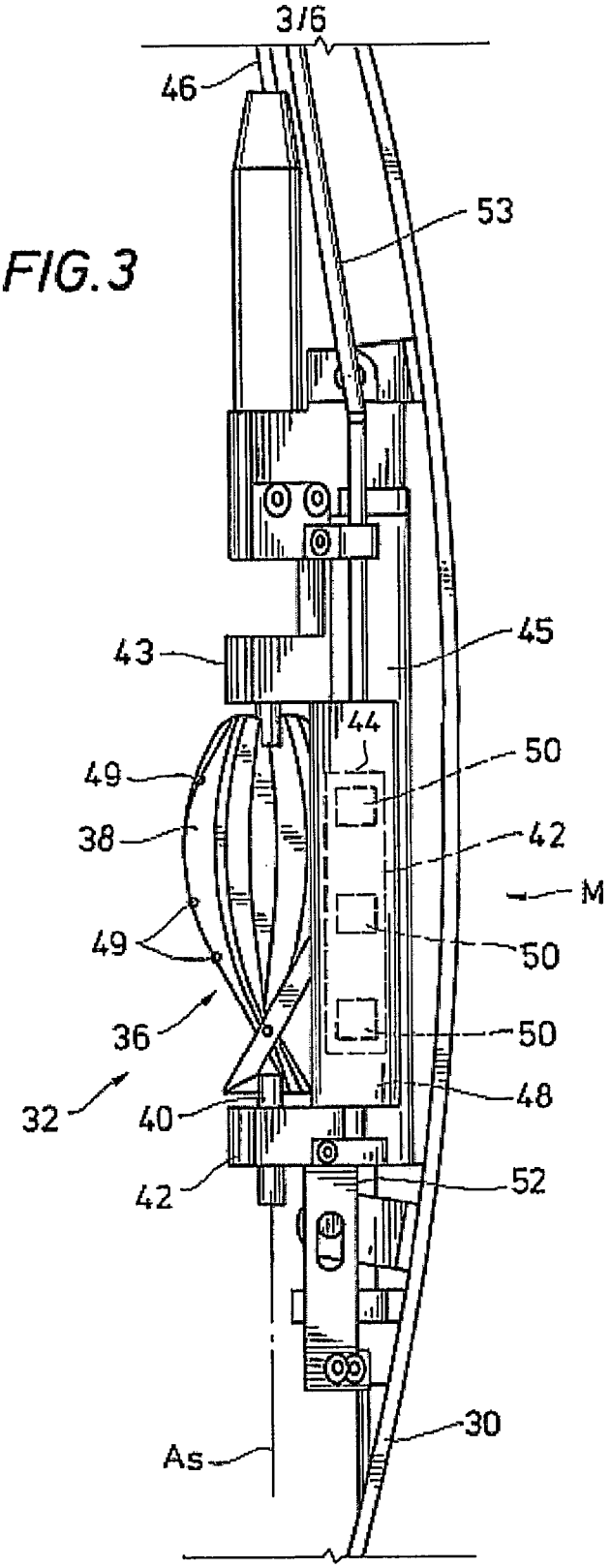
FIG. 3 is a side view of an example of a sensor module, which is included with the example of the sensor assembly of FIG. 2.

FIG. 3 illustrates in more detail one example of sensor module 32 and wherein module 32 includes a flow meter 36. In the example shown flow meter 36 is a spinner member 38 and illustrated as a planar element twisted into a helical configuration and supported on its opposite ends by shafts 40, 41 shown respectively mounted in posts 42 43. Thus, in an example when flow meter 36 is disposed in a stream of flowing fluid F, the motion of the fluid over spinner member 38 imparts a rotational force onto spinner member 38 thereby rotating spinner member 38 with respect to posts 42, 43. A rotational meter 44 is shown in dashed outline embedded in a body 45 of the flow meter 36, and which may detect the rotational speed or frequency of spinner member 38. Thus the combination of spinner member 38, shaft 40, and meter 44 can be used for estimating a flow rate of fluid flowing past the sensor module 32. Communication from the sensor module 32 may be provided through line 46 to a controller 47 (FIG. 1) showing an end terminating within sensor module 32 and an opposite end routed along the length of arm 30. Further shown is a shroud 48 that extends lengthwise adjacent to spinner member 38 and which mounts on body 45 of the flow meter 36. Body 45 provides mounting points for posts 42 and for mounting to arm 30. In the illustrated embodiment, magnets 49 may be included in the spinner member 38 for interacting with Hall effect sensors 50 shown in the flow meter 44. In an example, magnets 49 are provided at the same axial location in the spinner member 38, but on opposite lateral edges. By alternating the polarity of the magnets 49 at the opposite lateral edges, each rotation of the spinner member 38 can be detected by the Hall effect sensors 50. In an alternate example, the magnets 49 are spaced axially along the curved lateral edges at distances so that when viewed axially, adjacent magnets 49 are disposed 60° from one another.

Figure 4:
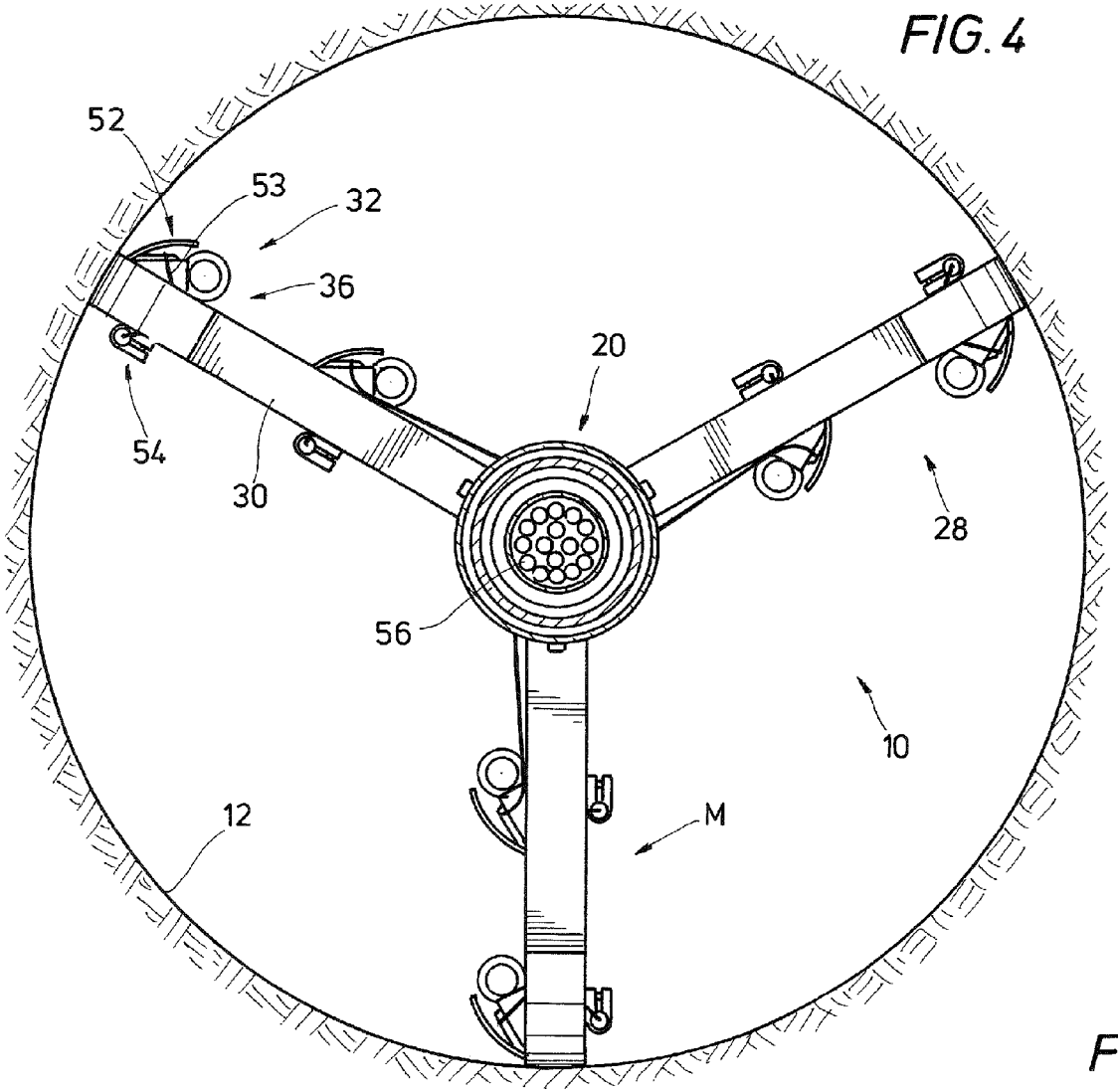
FIG. 4 is an axial view of an example of an example of a logging tool taken along lines 4-4 of FIG. 2.

Provided in FIG. 4 is an axial view of logging tool 10 taken along lines 4-4 of FIG. 2. In this example, a series of six sensor assemblies 28 are provided on tool body 20 and wherein the sensor arms 30 have a mid-section M that projects radially outward from body 20 and up against the wall of wellbore 12. Further shown in this example are additional sensors that are included with the sensor module 32. More specifically, further included in module 32 are an optical sensor 52 (FIG. 3), with attached optical sensor line 53, and conductivity sensor 54. In one example, the combination of the optical and conductivity sensors 52, 54 may be used for identifying the phase (i.e. gas, vapor, liquid, or combinations thereof) and/or type of fluid flowing through wellbore 12. For example, fluid may be hydrocarbon gas, hydrocarbon liquid, water, or other fluids flowing within wellbore 12 (FIG. 1). Furthermore, examples exist wherein in one of the sensor modules 32 in one portion of wellbore 12 may detect a fluid having substantially water, wherein another and differently located sensor module 32 may detect a wellbore fluid that is made up substantially of hydrocarbon liquid. This is extremely useful when tool 10 is disposed in either a horizontal or otherwise deviated portion of wellbore 12 and the different density fluids may stratify due to gravity. Knowing the sections of the cross-sectional stream of fluid that are made up of the different phases necessarily results in a more accurate estimate of the rate of fluid flowing through wellbore 12. Further shown in FIG. 4, are conduits 56 projecting axially through body 20. In one example, wires or other means for communicating signals may be inserted into the conduits 56 provided in body 20. In an example, a board (not shown) is disposed internal to the tool body 20 (FIG. 1), where signals from the sensors are provided to the board, and where the board communicates with lines in the conduits 56.

Referring now to FIG. 5, illustrated is one example of a position sensor 58. As will be described in more detail below, position sensor 58 can be used to estimate the orientation or position of arms 30. Further shown in the example of FIG. 5 is how end of arm 30 pivotingly couples to a slider block 60 which may slide axially within upper portion 22 of body 20. In the example shown, guide member 62, also housed within upper portion 22, is a thick walled element having an axially oriented opening which defines an axial path for the sliding movement of slider block 60 within. Projecting from and coupled with an end of slider block 60 distal from the end of arm 30 is a position rod 64, which is an elongate member and extends substantially parallel with axis $A_X$ of body 20. The end of position rod 64 distal from slider block 60 selectively inserts into and reciprocates within a position sensor receiver 66. In an alternative, position rod 64 includes a magnetic portion 68, which can be magnetized, and that can interact with a winding assembly 70 shown housed within position sensor receiver 66. As such, axial movement of arm 30 can be measured by the interaction of position rod 64 with position sensor receiver 66. Signals which may be transmitted to controller 47 (FIG. 1) can be analyzed to estimate axial location of the end of arm 30 and further thereby estimating location of the mid-portion M of arm 30, to thereby provide an estimate of the location of sensor modules $\mathbf{32}_1$, $\mathbf{32}_2$ (FIG. 2) and their relative distances from axis $A_X$. Thus, sensing the flow rate of any fluid flowing past tool 10 as well as the different phases of fluid at the differential spatial locations of sensor modules $\mathbf{32}_1$, $\mathbf{32}_2$ may provide full information about the cross-section of the entire amount of fluid flowing through wellbore 12. Spatial locations of the multiple sensor modules $\mathbf{32}_1$, $\mathbf{32}_2$ disposed on each of the multiplicity of arms 30 mounted to housing 20 can then in turn provide a detailed estimate of information of the fluid flowing through wellbore 12.

It should be pointed out, that each of the arms 30 moves independent from one another, and thus has a dedicated position sensor 58 associated with each arm. As such, the location of each of the individual sensor modules 32 may be estimated to give a more discreet and accurate estimate of fluid properties of fluid flowing through wellbore 12.

Figure 6:
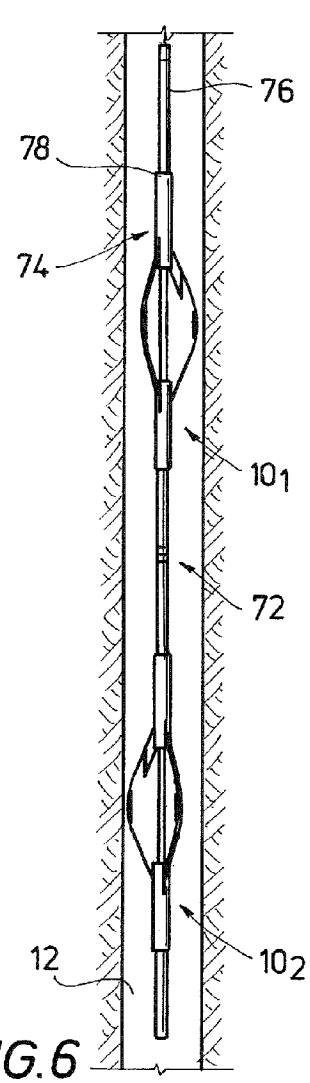
FIG. 6 is a side partial sectional view of an example of downhole logging tools coupled in series and disposed in a wellbore.

FIG. 6 shows a side view of a pair of downhole logging tools $\mathbf{10}_1$, $\mathbf{10}_2$ connected in series by connector 72. In this example, the logging tools $\mathbf{10}_1$, $\mathbf{10}_2$ are part of a downhole string 74. Further, downhole tool 76, which can be the same as or different from logging tool 101, can be connected to one end of logging tool $\mathbf{10}_1$ via connection 78.

Figure 7:
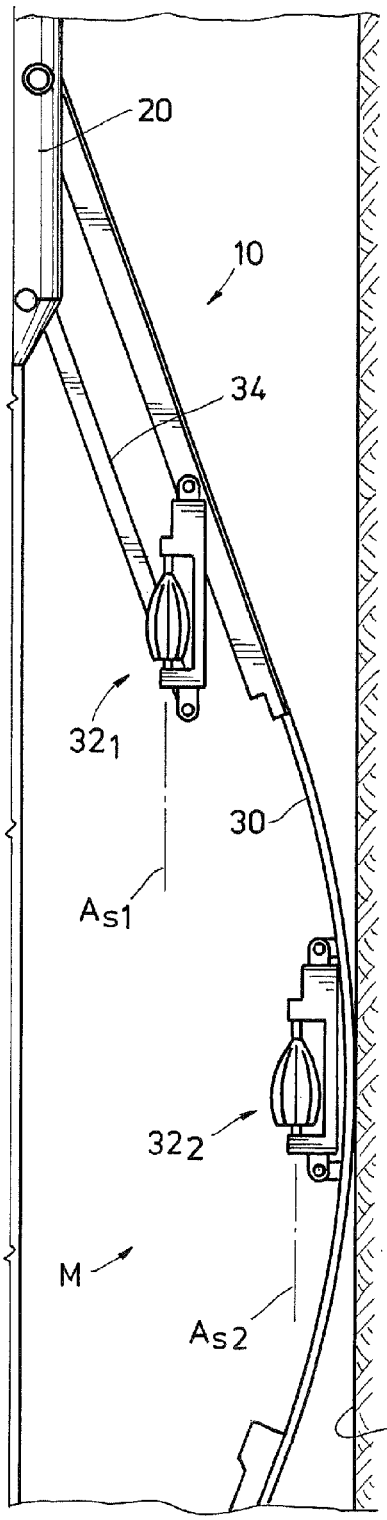
FIG. 7 is a side view of example orientations of sensor modules of the logging tool of FIG. 2.

FIG. 7 shows a cross-sectional view of one example of sensor modules $\mathbf{32}_1$, $\mathbf{32}_2$ and coupled to housing 20. As discussed above, an advantage of the system described herein is the ability to maintain sensor modules $\mathbf{32}_1$, $\mathbf{32}_2$ in an orientation that is substantially the same throughout use of the tool 10 within wellbore 12. Further, as discussed above linkage arm 34 maintains sensor module $\mathbf{32}_2$ in an orientation so that its axis $A_{S1}$ maintains a position substantially parallel with axis $A_X$ of tool 10. Moreover, as sensor module $\mathbf{32}_2$ is mounted proximate a mid-portion M of arm 30, its axis $A_{S2}$ also remains in an orientation that is substantially parallel with axis $A_X$. Alternate embodiments exist wherein the orientations of the modules $\mathbf{32}_1$, $\mathbf{32}_2$ are maintained at separate designated angles oblique with respect to axis $A_X$.

Figure 8:
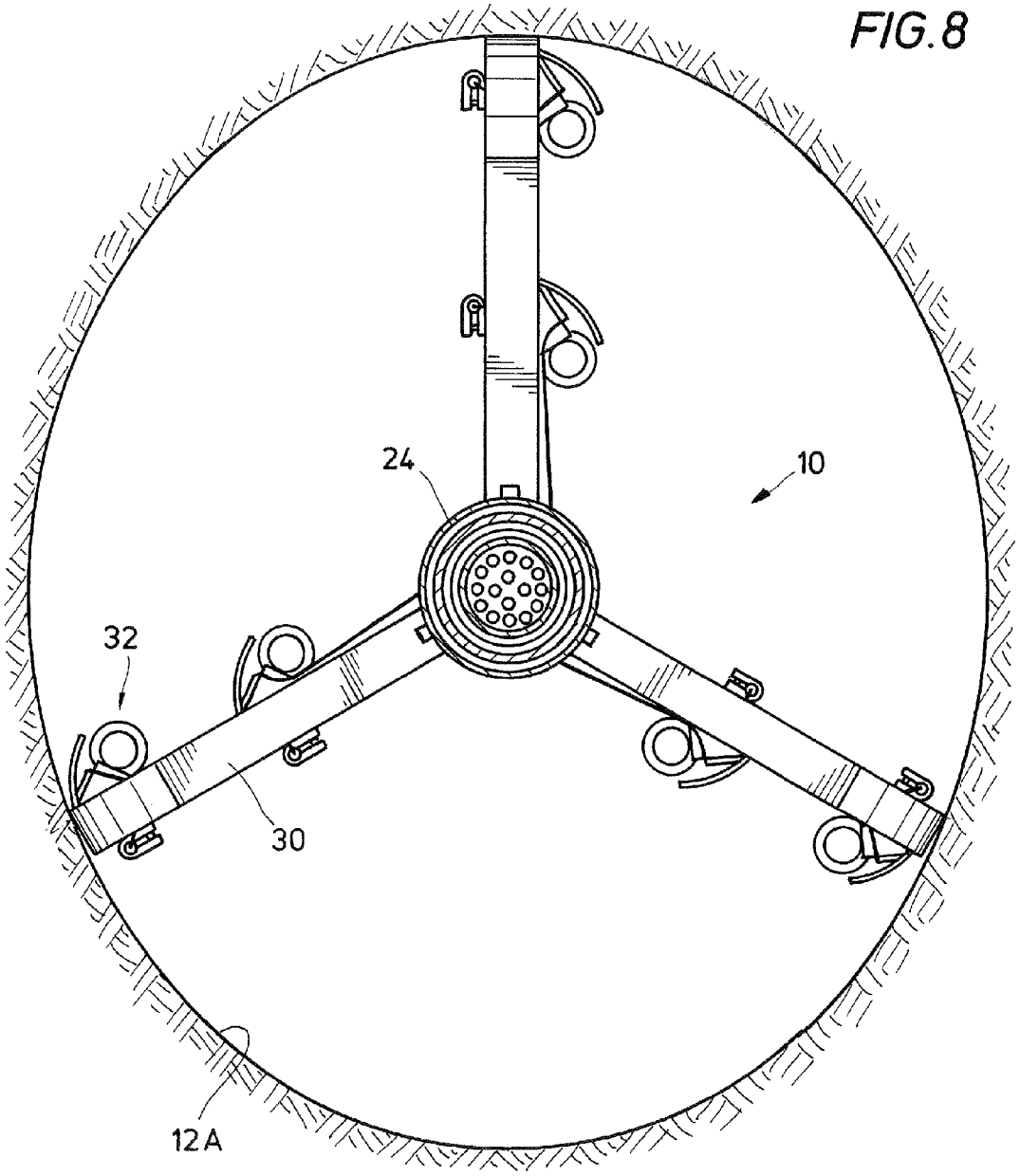
FIG. 8 is an axial view of an example of the logging tool in a wellbore having a non-uniform radius.

FIG. 8 illustrates one example of tool 10 and disposed within wellbore 12A, wherein wellbore 12A has a radius that varies along its circumference. As indicated above, each of the arms is independently moveable with respect to other arms, thus each of the arms may have a mid-section M that projects radially outward and into contact with wellbore wall. Accordingly, some of the modules are at a distance that is different from modules on adjacent arms 30. However, the aforementioned position sensors 58 allow for an accurate estimate of the actual spatial location of each of the modules 32 within wellbore 12A.

Figure 9A:
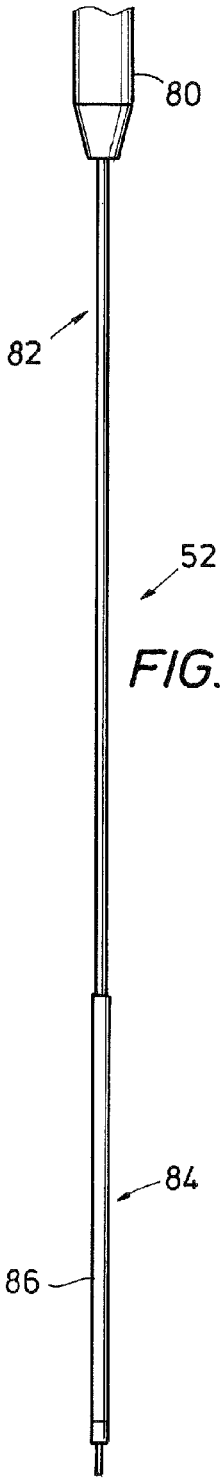
FIGS. 9A and 9B are side views respectively of an optical sensor and a conductivity sensor.
Figure 9B:
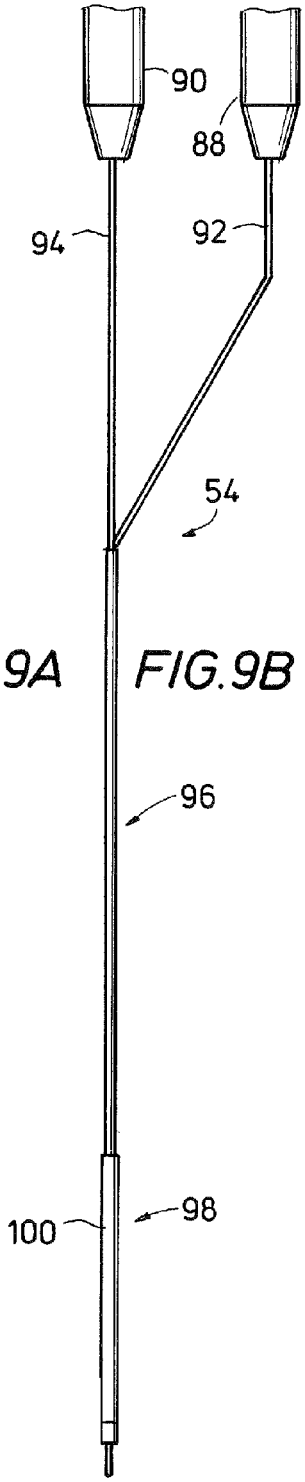

Shown in FIGS. 9A and 9B are examples of the optical sensor 52 and conductivity sensor 54. The optical sensor 52 includes a boot 80 on one end, which can optionally include material made of rubber, and a fiber 82 shown extending from a narrower end of the boot 80. A shielding material may cover the fiber 82. An optical probe 84 couples to an end of fiber 82 distal from boot 80, where the probe 84 may be encased in tubing 86, which can be made of steel, composite, or combinations thereof. The conductivity sensor 54 also includes boots 88, 90, which can be made of a material having rubber. A pair of leads 92, 94 are respectively shown exiting the narrower ends of boots 88, 90. Distal from boots 88, 90 leads 92, 94 extend through a length of tubing 96 and into a conductivity probe 98 that is on a side of tubing 96 opposite from boots 88, 90. Probe 98 is encased in tubing 100, that may be made from steel, composite, other materials, or combinations thereof.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example the tool 10 can be used bidirectionally in the wellbore 12, that is, sensing can occur when raising or lowering the tool 10 in the wellbore 12. Optionally, the orientation of the tool 10 in the wellbore 12 can be the opposite of that shown in FIG. 1, i.e. the tool 10 can be disposed such that lower portion 24 is above upper portion 22. Similarly, the tools $\mathbf{10}_1$, $\mathbf{10}_2$ in string 74 of FIG. 6 could be oriented oppositely, i.e., one with the lower portion 24 above upper portion 22, and the other with the upper portion 22 above lower portion 24. These and other similar modifications will readily suggest themselves to those skilled in the art, and are intended to be encompassed within the spirit of the present invention disclosed herein and the scope of the appended claims.

What is claimed is:

1. A downhole tool for use in a wellbore comprising:

a body;

elongate arms having opposing ends that each couple with the body;

pinned connections coupled with the body and coupled with a forward end of each elongate arm, and about which the forward ends are pivotable, the pinned connections being circumferentially spaced apart from one another;

slider blocks pivotingly coupled to aft ends of each of the elongate arms and that are axially slidable within guide members that extend axially on the body and that are circumferentially spaced apart from one another, so that when a mid-portion of each elongate arm moves radially with respect to the body, the respective slider blocks move axially within the guide member, and independent of all other slider blocks so that each of the elongate arms moves independent of all of the other elongate arms; and a sensor module on each elongate arm that is in selective contact with fluid in the wellbore, and that comprises a fluid flow meter and a fluid phase sensor, the fluid flow meter comprising a planar member twisted into a helical configuration to define a spinner that is oriented substantially parallel with the body.

2. The downhole tool of claim 1, wherein the fluid phase sensor comprises a conductivity sensor and an optical sensor, and wherein the conductivity sensor comprises an elongate conductivity probe encased in tubing, and leads that connect to the conductivity probe.

3. The downhole tool of claim 1, wherein the fluid flow meter and fluid phase sensor are disposed at substantially the same radial distance from the body.

4. The downhole tool of claim 1, further comprising position sensors coupled with each of the slider blocks, so that when the elongate arms and sensor modules project radially outward from the body, radial distances of each of the sensor modules from the body is measured.

5. The downhole tool of claim 1, further comprising magnets disposed on opposing lateral edges of the spinner, wherein the magnets have opposing polarities.

6. The downhole tool of claim 1, wherein a mid-section of each elongate arm selectively contacts a wall of the wellbore.

7. The downhole tool of claim 6, wherein the sensor modules comprises at least first and second sensor modules, wherein the second sensor module is disposed on the arm at a distance from an axis of the body that is different from a distance between the first sensor module and the axis of the body, and wherein the first and second sensor modules are at a known distance from the axis of the body.

8. The downhole tool of claim 6, further comprising a linkage bar having an end pivotingly coupled with the body and a distal end pivotingly coupled with the sensor module so that when the arm moves radially with respect to the body, the sensor module is retained in an orientation substantially parallel with an axis of the body.

9. A downhole tool for use in a wellbore comprising:

a body;

at least three elongate arms spaced angularly apart from one another around the body, each arm formed from a single flexible member having a first end pivotingly coupled with the body, a second end pivotingly attached to a block that slides axially along the body so that each of the three elongate arms is moveable independent of each of the other elongate arms, and a mid-portion selectively projecting radially outward from the body to different distances from the body;

sensor modules mounted on each arm, each sensor module comprising a fluid flow meter and fluid phase monitor; and a means for estimating distance between each of the sensor module and an axis of the body when the sensor modules move in response to the mid-portion of the elongate arms projecting to the different distances.

10. The downhole tool of claim 9, wherein the fluid phase monitor comprises an optical sensor and conductivity sensor.

11. The downhole tool of claim 9, wherein the means for estimating a distance comprises a linear variable differential transformer that receives a magnetic rod that is coupled to the second end of the arm.

12. The downhole tool of claim 9, further comprising a linkage arm having an end pivotingly coupled to the body, and a distal end pivotingly coupled to the sensor module, so that when the mid-portion moves with respect to the body, the sensor module remains substantially parallel with the axis of the body.

13. The downhole tool of claim 9, wherein the fluid flow meter comprises a spinner member formed from a planar member deformed into a helical shape, and that rotates on a shaft, and wherein monitoring rotation of the shaft provides an indication of a rate of flow of fluid in the wellbore.

* * * * *